United States Patent [19]

Stipanuk et al.

[11] 3,950,060

[45] Apr. 13, 1976

[54] CONNECTOR ASSEMBLY

[75] Inventors: John M. Stipanuk, Glen Ellyn; Kerry M. Krafthefer, Naperville, both of Ill.

[73] Assignee: Molex Incorporated, Lisle, Ill.

[22] Filed: Oct. 29, 1974

[21] Appl. No.: 518,276

[52] U.S. Cl. ..... 339/91 R; 339/128; 339/184 M

[51] Int. Cl.[2] ..... H01R 13/64

[58] Field of Search ..... 339/17 C, 17 M, 17 LM, 339/91 R, 126 R, 128, 184 R, 184 M, 186 R, 186 M, 276 A

[56] References Cited

UNITED STATES PATENTS

| | | | |
|---|---|---|---|
| 2,239,255 | 4/1941 | Shaw | 339/128 |
| 3,191,135 | 6/1965 | Hazelquist | 339/128 |
| 3,500,288 | 3/1970 | Startin | 339/184 M |
| 3,579,170 | 5/1971 | Baumanis | 339/17 L |
| 3,644,792 | 2/1972 | Fields | 339/17 C |
| 3,662,321 | 5/1972 | Bury | 339/128 |
| 3,740,697 | 6/1973 | Van Son | 339/186 M |
| 3,812,450 | 5/1974 | Simovits | 339/128 |

*Primary Examiner*—Roy Lake
*Assistant Examiner*—Mark S. Bicks
*Attorney, Agent, or Firm*—Louis A. Hecht

[57] ABSTRACT

An electrical connector assembly for use in an electrical circuit which has a support member for mounting electrical components thereon. The support member includes a first aperture and a second aperture. A first electrical connector is provided for mounting on the support member and includes an insulated base adapted to be received in the first aperture and a plurality of generally rigid conductor pins extending from at least one side of the base. The base has a plurality of indexing openings along the periphery thereof. One of the openings is in alignment with the second aperture. The base also includes a plurality of resilient hook-shaped support member engaging tabs, one underlying each of the indexing openings for engaging the bottom of the support member when the first connector is mounted in the first aperture. A second electrical connector is provided to be mounted and spaced from the first electrical connector. The assembly also includes a stepped-shaped polarizing pin attached to the second connector and adapted to cooperate with the second aperture and the first connector so that the second connector is positioned in a given way with respect to the first connector.

9 Claims, 10 Drawing Figures

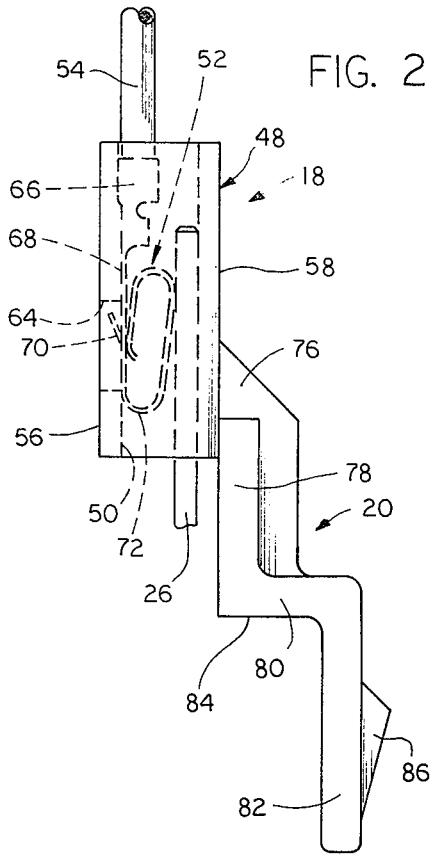
FIG. 2
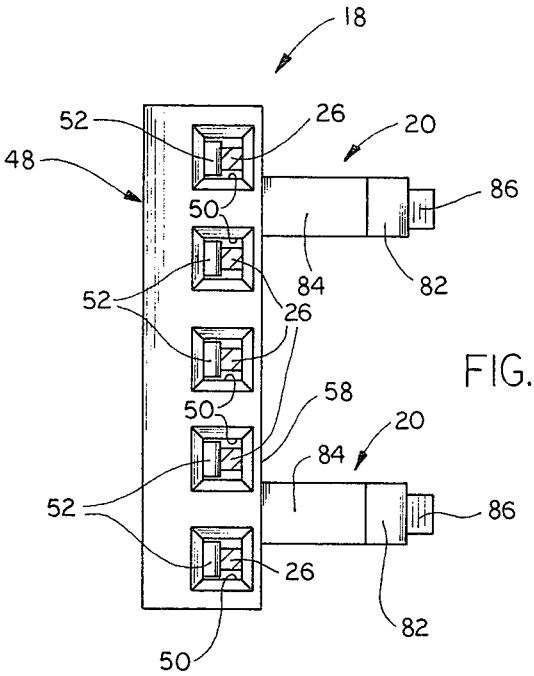
FIG. 3
FIG. 4
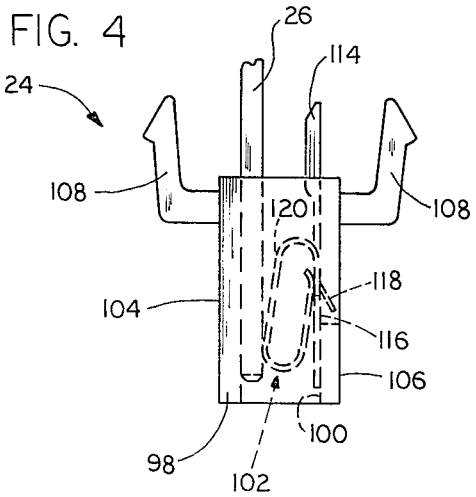
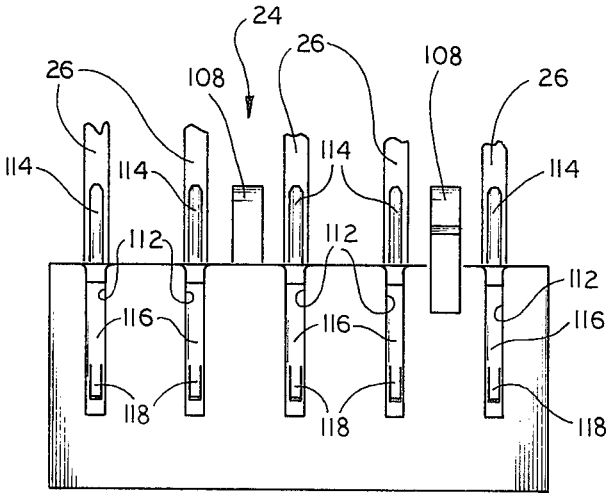
FIG. 5

FIG. 9
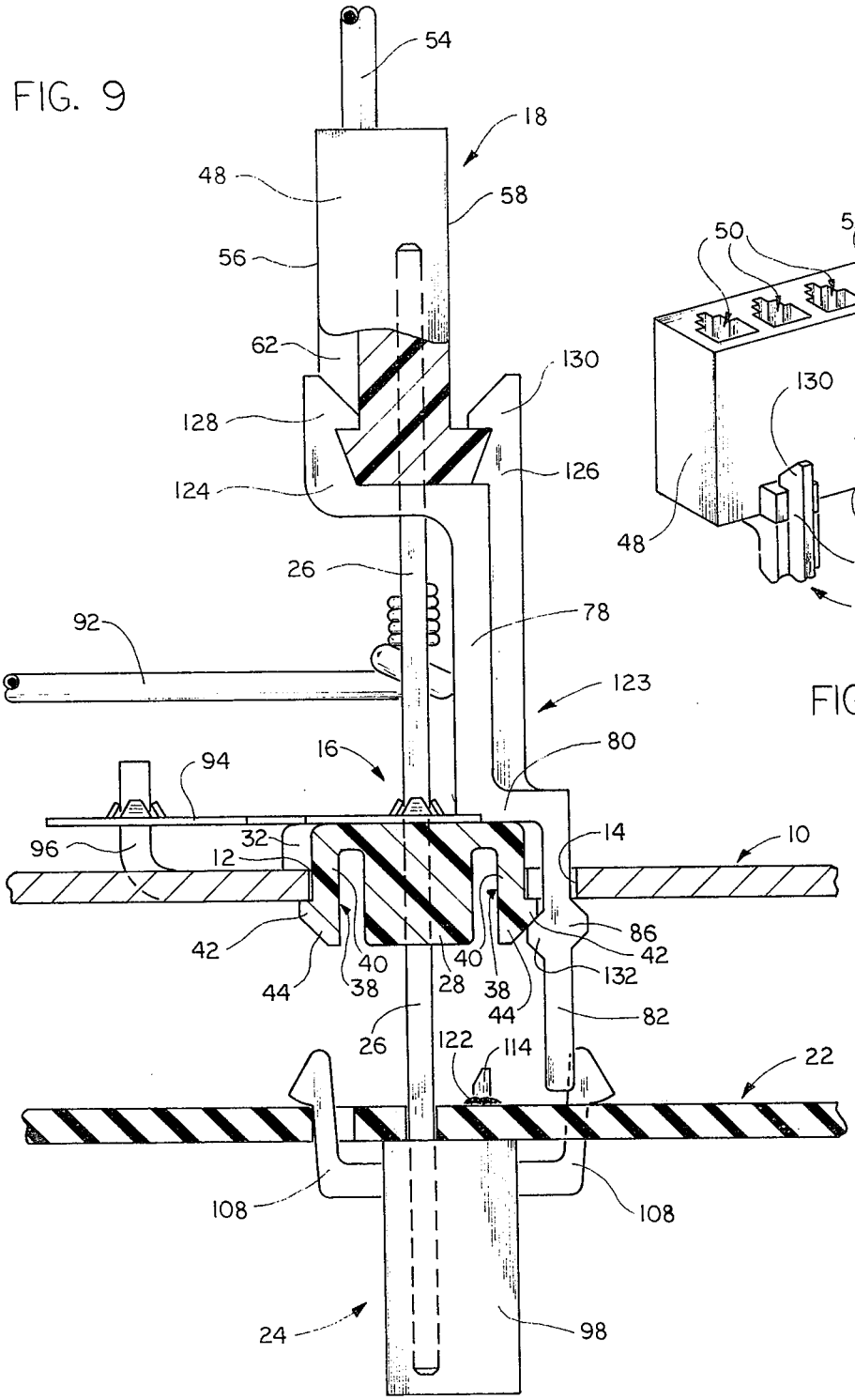
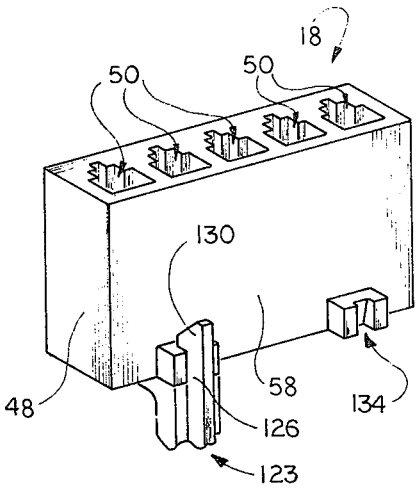
FIG. 10

CONNECTOR ASSEMBLY

BACKGROUND OF THE INVENTION

1. Field of the Invention

The present invention relates to electrical connectors in general and, more particularly, to electrical connector assemblies employing means to index one component with respect to another component and to electrical connectors known as pin connectors.

2. Brief Description of the Prior Art

With the advent of mass-produced electronic products, it has always been desirable to produce electronic assemblies which are easy to manufacture, easy to assemble, i.e., can easily be assembled in a certain way without confusion, and are modular.

One means of providing an electronic assembly which could easily be assembled in only a given way is to use a polarizing pin or the like. In such assemblies, a polarizing or indexing pin is attached to one component so that it cooperates with either another component or a support member to position that first component in a given way with respect to the second component.

Another means of producing an easy-to-assemble electrical assembly is to use components that can be fit into a support member. However, all the designs in the prior art are such that manufacture and assembly of such components are relatively expensive or, such components cannot be easily used in associated with other components. In short, the prior art does not disclose an electrical assembly employing a plurality of electrical connectors which are easily manufactured, put together in a given way, and are easily interchangeable.

SUMMARY OF THE INVENTION

It is, therefore, the principal object of the present invention to provide an electrical connector assembly which is easy to manufacture, easy to assemble in a given way and is easily interchangeable between other components.

These and other objects of the present invention are accomplished by one connector assembly comprising the preferred embodiment. The connector assembly generally includes a support member for mounting electrical components thereon. The support member includes an aperture formed therethrough. A circuit element is mounted on the support member. The circuit element has conductive means extending from at least one side of the support member. An electrical connector having a housing and terminal means mounted in the housing is adapted to receive the conductive means so that the conductive means is electrically connected to the terminal means. Polarizing means is associated with the connector and adapted to cooperate with the aperture to position the connector in a given way with respect to the circuit element. The polarizing means includes a locking portion adapted to be received in the aperture to lock the connector with respect to the support member. The polarizing means also includes a spacer portion adapted to cooperate with the circuit element to space the connector a given distance away from the circuit element.

In the preferred embodiment, the circuit element is in the form of an electrical connector adapted to be mounted on a support member through a connector aperture formed therein, having an aperture edge. The connector generally includes an electrically conductive portion, and an insulated base portion to support the conductive portion. Support member engaging means are formed on at least a portion of the periphery of the base portion for locking the base portion to the support member. The support member engaging means generally includes a top portion extending laterally from the base portion adapted to overlay at least a portion of the edge of the connector aperture, and a generally resilient L-shaped hook portion having a first leg depending from the base and a second leg extending laterally therefrom spaced from and underlying the top portion. At least a portion of the aperture edge is received in a snap-fit fashion between the top portion and the second leg when the connector is mounted in the support member. The hook portion has cam means formed thereon to engage the aperture edge for moving the second leg from a normal position to a retracted position. This allows insertion of a connector in the aperture. The resiliency of the hook portion allows the second leg to snap back to its normal position under the support member after complete insertion.

BRIEF DESCRIPTION OF THE DRAWINGS

FIG. 2 is a side view of a harness connector and a polarizing pin used in the present invention;

FIG. 3 is a bottom plan view of the harness connector shown in FIG. 2;

FIG. 4 is a side view of a printed circuit board connector used in the present invention;

FIG. 5 is a side view taken from another side of the printed circuit board connector shown in FIG. 4;

FIG. 9 is a side view, partially in section, of another embodiment of the connector assembly of the present invention; and FIG. 10 is a perspective view of the harness connector used in the connector assembly shown in FIG. 9.

DESCRIPTION OF THE PREFERRED EMBODIMENT

Figure 1:
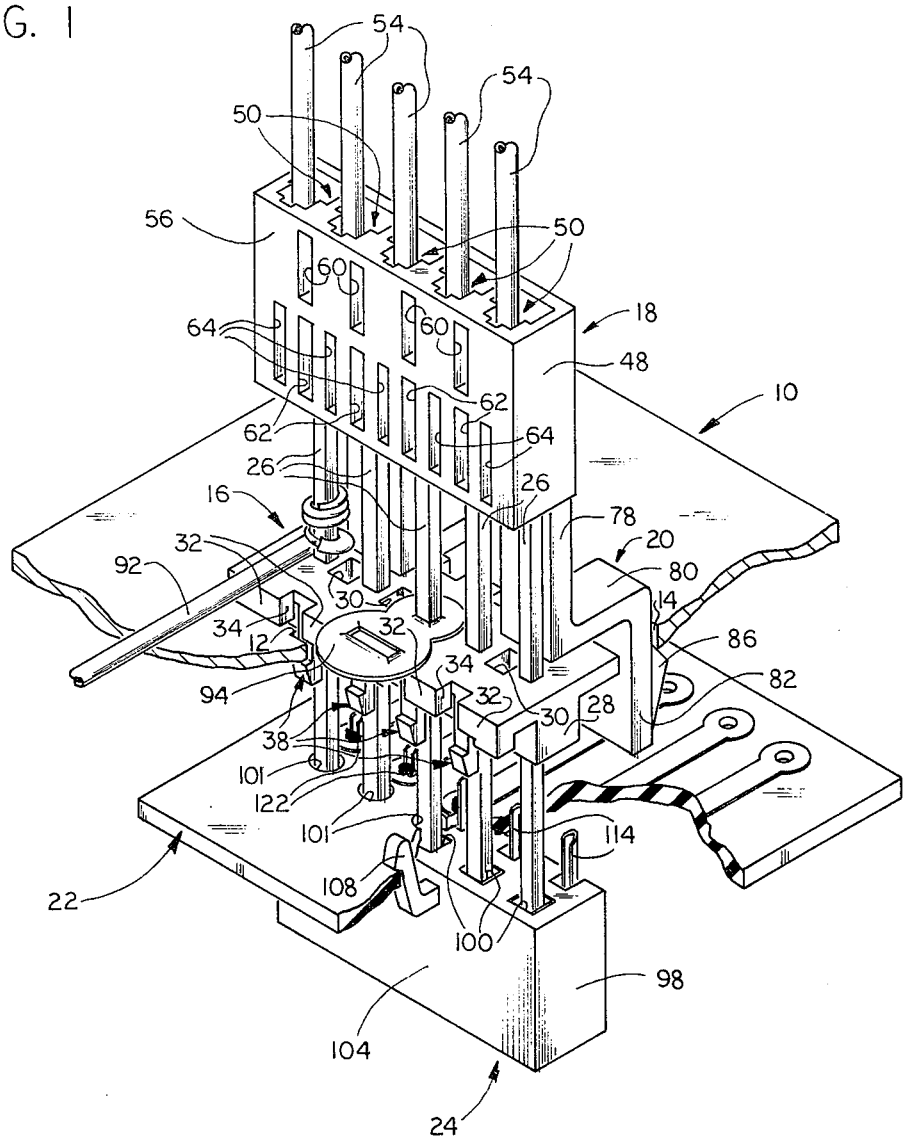
FIG. 1 is a fragmentary perspective view of one connector assembly of the present invention.

Turning now to FIG. 1, the electrical connector assembly of the present invention forming a part of an electrical circuit is shown supported on a support member 10 such as a chassis or the like, which has a connector aperture 12 and an indexing aperture 14 formed therein. A pin connector, generally designated 16, is snapfit mounted into the connector aperture 12. A wire harness connector, generally designated 18, is mounted on top of the pin connector 16 and is in turn electrically connected to another part of the electrical circuit. Two polarizing pins, each generally designated 20, (FIGS. 1–3) is associated between the connector assembly 18 and the pin connector 16 and the indexing opening 14 to align and position the connector assembly 18 in a given manner with respect to the pin connector 18. Although two pins 20 are shown, more or less can be used.

In the present embodiment, a printed circuit board, generally designated 22, is provided below the support member 10. The pin connector 16, and harness connector 18 are electrically connected to the printed circuit board 22 by means of a printed circuit board connector, generally designated 24. The printed circuit board connector 24 is mounted on the bottom of the pin connector 16 and is electrically connected to the circuit on the printed circuit board 22.

Figure 6:
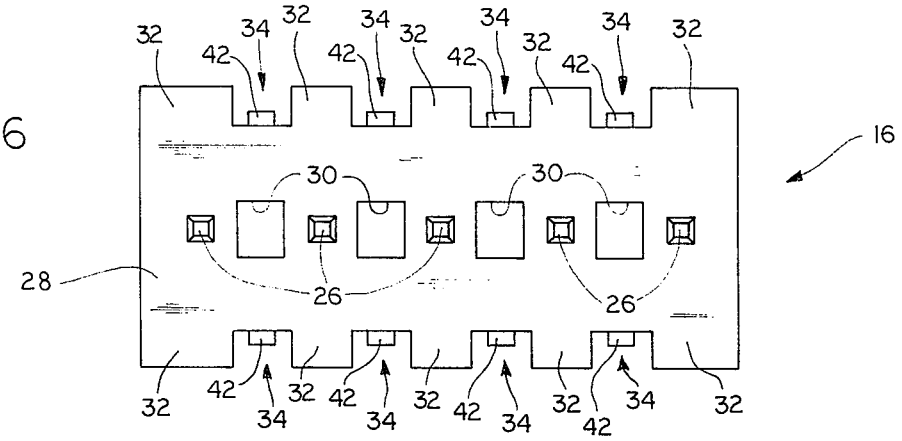
FIG. 6 is a top plan view of a pin connector used in the present invention.
Figure 7:
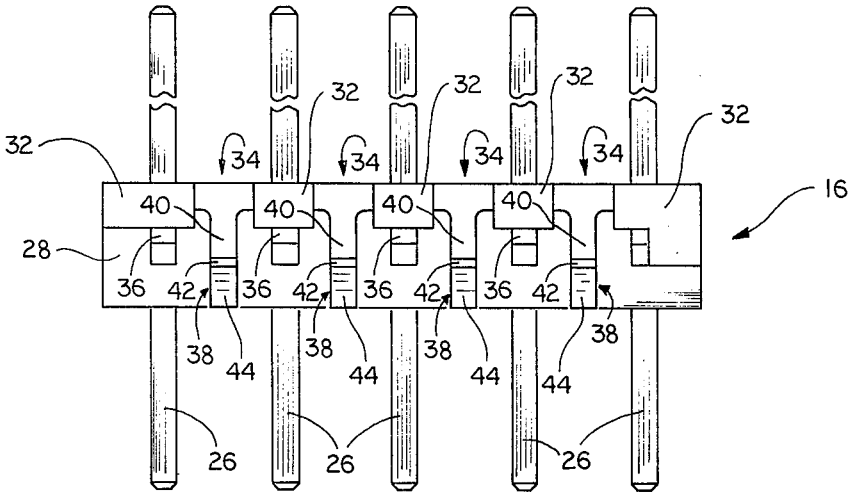
FIG. 7 is a side view of the pin connector shown in FIG. 6.
Figure 8:
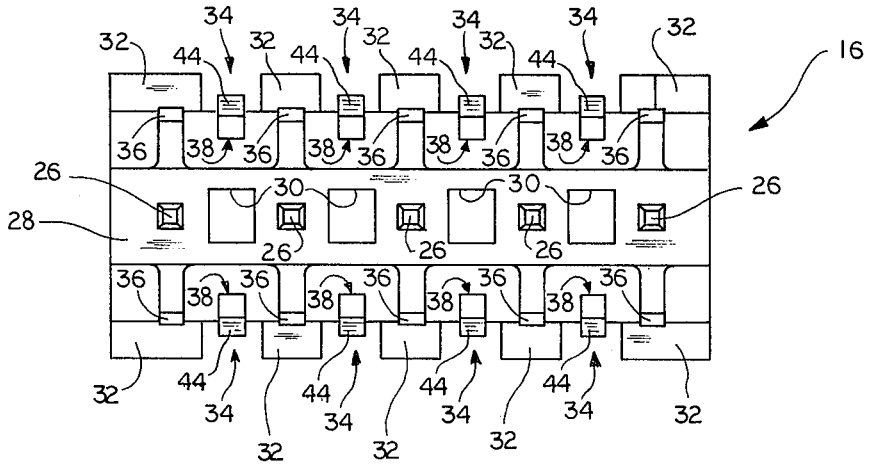
FIG. 8 is a bottom plan view of the pin connector shown in FIG. 6.

Looking now at FIGS. 6–8, the pin connector 16 is seen to generally include a plurality of rigid metal conductive pins 26 embedded in and extending from either side of an insulated base portion 28. A plurality of coring apertures 20 are formed through the base portion 28 to save in material costs. In addition, the coring apertures relieve stresses created between pins 26 during insertion thereby holding dimensional tolerances.

While the pins 26 shown herein are square in cross-section, it is understood that the pins can be of any suitable shape. In addition, the length of the pins can be made as desired and can be designed so that they extend from only one side of the base portion 28, if desired.

Formed around the periphery of the base portion 28 is support member engaging means for locking the base portion to the support member. The support member engaging means generally includes a top portion made of a plurality of spaced apart tabs 32 extending laterally from the base portion which are adapted to overlay at least a portion of the edge of aperture 12, having spaces 34 therebetween. A stop shoulder 36 is formed below each of the tabs 32 for reasons which will become more apparent hereinafter.

Resilient generally hook-shaped members generally designated 38 (FIGS. 1 and 6–8), are mounted on the base portion 28. Each hook-shaped member 38 includes a vertical leg 40, depending from the base portion 28 and a second horizontal leg 42 extending laterally from the vertical leg 40. Each horizontal leg 42 is spaced from the top of the base portion 28 and underlies each of the spaces 34 between tabs 32 as best shown in FIGS. 6 and 8.

The distance between the ends of the horizontal legs 42 on one side of the base portion 28 and the ends of the horizontal legs 42 on the other side of the base portion is greater than the width of the opening 12 in the support member 10. Thus, in order to ensure easy insertion of the pin connector 16 into the opening 12, there is provided a cam surface 44 formed below the horizontal leg 42 of the hook-shaped portion 38. The cam surface 44 of each hook-shaped member 38 is adapted to engage the edge of the opening 12 when the connector is to be inserted so that the hook-shaped members 38 will be resiliently moved inwardly to accomodate insertion of the pin connector 16. Upon complete insertion of the pin connector 16, the support member 10 will be received between the horizontal leg 42 of the hook-shaped members 38 and the top tabs 32. The sides of the support member 10 when engaged in the manner described, will abut the stop shoulders 36 and the vertical leg 40 of the hook-shaped members.

The resiliency of the hook-shaped members 38 ensures that the horizontal leg 42 will snap back under the support member 10 to provide a close snap-fit relationship. Thus, the pin connector 16 as described, offers easy insertion and sure mounting in a suitable support member 10 having an aperture or opening 12 formed therein.

Looking now at FIGS. 1–3, the harness connector 18 includes a housing 48 made of suitable insulation material having a plurality of pin receiving cavities 50 formed therein for receiving the pins 26 of the pin connector 16. Each of the cavities 50 also receives a loop-shaped terminal 52 for electrically connecting the pins 26 with an insulation clad wire 54.

The housing 48 has two side walls 56 and 58. Side wall 56 has a top row of coring recesses 60 and a bottom row of coring recesses 62. Between each adjacent pair of bottom row coring recesses 62, there is provided a slotted side opening 64, each communicating with a respective pin receiving cavity 50.

Looking at FIG. 2, the terminal 52 is seen to generally include a crimp section 66 secured to a portion of wire 54, a base portion 68, a lance 70 struck from the base portion 68, and a generally loop-shaped portion 72. The terminal 52 can be fabricated of a single piece of sheet brass or other suitable metal which is formed to the shape shown and spring tempered to provide a resilient body.

Each slotted side opening 64 receives the lance 70 of each terminal 52 which serves to locate the terminal in a pre-determined position within the cavity 50. In addition, accidental retraction of the terminal 52 is prevented by virtue of the lance 70 abutting the slotted side opening 64.

When the pins 26 of pin connector 16 are plugged into connector 18, by receiving pins 26 within cavities 50, the loop-shaped portions 72 flatten out to some extent as shown in FIG. 2. Each pin 26 is confined between the loop-shaped portion 72 and an interior wall (not numbered) of the cavity 50 by reason of the spring pressure exerted by the terminal 52. This forms a mechanical and electrical connection between the individual pins 26 and the respective terminals 52. At the same time, the pin connector 16 is electrically connected to the harness wires 54 which are connected to another part of the circuit. It can be appreciated that rather than employing a crimp-type connector as the connector 18, one can also use a printed circuit board type connector in association therewith.

Turning now to FIGS. 1 and 2, the polarizing pin 20 is seen to generally be in the shape of a step and has a top portion 76 integrally molded with the harness connector housing 48, an upper vertical leg 78 extending downwardly therefrom, a horizontal leg 80 extending laterally from said vertical leg 78 and a lower vertical locking leg 82 extending downwardly from the horizontal leg 80. The lower leg 82 is adapted to be received through indexing opening 14 when the harness connector 18 is mounted on top of the pin connector 16. When the harness connector 18 is fully mounted on the pin connector 16, the bottom surface 84 of the horizontal leg 80 is adapted to lay on the top of the base portion 28 of the pin connector 16. Thus, depending on the length of the upper vertical leg 78, a given length of the pin connector pins 26 will be exposed.

In order to lock the polarizing pin 20 into the support member 10, the vertical locking leg 82 is provided with a detent 86 extending laterally therefrom. The detent engages the edge of the index opening 14 causing the vertical leg 82 to flex somewhat. However, after the pin 20 is fully inserted within the opening 14, the detent 86 passes the edge of the opening causing the leg 82 to snap back to its initial position. This places the detent 86 under the support member in a removable friction locking relationship. The lower locking leg 82 sets the height above pin 26 so that electrical contact will not be effected between terminal 52 and pin 26 before indexed and locked through opening 14.

Because a given length of the pins 26 can be exposed, other electrical components can be connected between the pins and another part of the circuit. For example, a wire wrap 92 (FIGS. 1 and 9) and a buss bar 94 attached to a ground member 96 (FIG. 9), can be secured to different pins 26 of the pin connector 16. If desired, the length of the upper vertical leg 78 can be short enough so that virtually no length of pins 26 will be exposed.

The polarizing pin 20 or pins, can be molded on different positions along wall 58 of housing 48 to key that particular connector 18 to a given location on the support member 10. That is, should there be a plurality of pin connectors 16 is a given circuit which are mounted on the support member 10 at different locations and there is to be a corresponding harness connector 18 for each location, one can ensure that the right harness connector 18 is mounted on the right pin connector 16. For each different location, all that need to be done is to provide an indexing opening 14 adjacent the connector opening 12 in a different relative position. Then, by molding the polarizing pin 20 at different positions on the connector 18 so that the locking leg 82 is alignable and insertable into that particular indexing opening 14, only the correct connector 18 will be placed on the correct corresponding pin connector 16 at that location.

Looking now at FIGS. 1, 4 and 5, the printed circuit connector 24 is mounted below printed circuit board 22 and is seen to generally include a housing 98 having a plurality of pin receiving cavities 100 formed therein. Each pin receiving cavity 100 is adapted to receive each of the connector pins 26 which extend through openings 101 formed in board 22. Each of the cavities 100 also receives a loop-shaped printed circuit board type terminal 102. These terminals 102 serve to electrically connect the pin connector pins 26 with a portion of the printed circuit board 22.

Looking at FIGS. 1, 4, and 5, the housing 98 is seen to include two side walls 104 and 106. A resilient mounting prong 108 is formed on each side wall 104 and 106. Side wall 104 has a plurality slotted side openings 112 communicating with the interior of each cavity 100.

The housing 98 is initially mounted on the printed circuit board 22 by inserting the prongs 108 through openings (not numbered) formed in the printed circuit board. This serves to position the printed circuit board connector prior to soldering and, in addition, prevents breaking of any soldered connection due to instability.

Looking at FIG. 4, the printed circuit type terminal 102 has a printed circuit tail 114, a base portion 116, a lance 118 struck from the base portion 116, in a generally loop-shaped 120. The terminal 102 is fabricated of a single piece of sheet brass or other suitable metal which is formed to the shape shown and spring-tempered to provide a resilient body.

The terminal 102 is insertable into the cavity 100 so that the lance 118 is received within the slotted side opening 112. This serves to position the terminal 102 in the cavity 100 and also prevents accidental retraction of the terminal from the cavity.

When the terminal 102 is inserted in the cavity 100 as shown in FIG. 1, the printed circuit tail 114 projects through the top of cavity 100 through a hold (not numbered) in the printed circuit board 22. The tail 114 is secured, as by solder 122, to the circuit wiring of the printed circuit board 22 so that the circuit board is fixed with respect to the connector 24.

As with the terminals 52 of the harness connector 18, when the pins 26 of the pin connector 16 are plugged into the cavities 100 of the printed circuit board connector 24, the loop-shaped portions 120 flatten out to some extent as shown in FIG. 4. Each pin 26 is confined between the loop-shaped portion 120 and an interior wall (not numbered) of the cavity 100 by reason of the spring pressure inserted by the terminal. Once again, this forms a mechanical and electrical connection between the individual pins 26 in respective terminals 102. At the same time, the pin connector 16 is connected to the circuitry of the printed circuit board 22 through the printed circuit tails 114. It can be appreciated that rather than employing a printed circuit board type connector as connector 24, one can also use a crimp-type connector.

Turning now to FIGS. 9 and 10, the connector assembly illustrated is essentially identical to that shown in FIG. 1. The main difference between the assembly shown in FIG. 9 and that of FIG. 1 is that the polarizing pin, generally designated 123 in FIG. 9, is removably attached to the harness connector housing 48 rather than being molded thereto as in FIG. 1. Because all of the components are essentially the same, the same reference numerals will be used in FIG. 9 and 10 as in all the other figures except for portions of the polarizing pin 123 different from the pin 20 shown in FIG. 1.

The connector engaging portion of the pin 123 comprises a generally Y-shaped top having two prongs 124 and 126, each having a hook 128 and 130 respectively formed at the end thereof. In addition to the detent 86, the lower vertical locking leg 82 has an opposite facing second detent 132. This second detent 132 cooperates with the horizontal leg 42 of the hook-shaped portion 48 of the pin connector 16 as best shown in FIG. 9. That is, the second detent 132 pushes the hook-shaped portion 38 inwardly as it is being inserted through the indexing opening 14.

The space 34 between the tabs 32 serve as indexing openings to receive the lower locking leg 82 therethrough. Accordingly, the indexing opening 14 formed in the support member 10 is alignable with one of the spaces 34 between tabs 32.

Side wall 58 of housing 48 has a plurality of notches 134 formed thereon opposite and corresponding to the coring recesses 62 on side wall of 56. Hook 128 is snap-received into coring recess 62 whereas hook 130 is snap-fit into the notch 134 directly opposite the coring recess. However, pin 123 is adapted so that hooks 128 and 130 can be snap-fit on either side wall 56 or 58 as described. This design allows the placement of a single pin 123 in a plurality of positions on the connector housing 48 on either side thereof.

We claim:

1. A connector assembly for use in electrical circuit comprising:

a support member for mounting and electrically connecting circuit elements thereon, said support member including a first aperture and a second aperture;

a first electrical connector including an insulated base adapted to be mounted in said aperture and a plurality of generally rigid conductive pins extending from at least one side of said base, said base including a plurality of indexing openings along the periphery thereof, one of said openings being in alignment with said second aperture, said base further including a plurality of resilient hook-shaped support member engaging tabs, one underlying each of the indexing openings for engaging the bottom of the support member when the first connector is mounted in said first aperture;

a second electrical connector including a housing having a plurality of recesses to receive said pins and a terminal mounted in each recess to electrically contact each pin; and a stepped-shaped polarizing pin attached to said second connector and adapted to cooperate with said second aperture, said aligned indexing opening and said respective support member engaging tab to position the second connector in a given way with respect to said first connector, said polarizing pin including a portion engaging the second connector, a generally horizontal portion adapted to rest on top of said first connector base for spacing the second connector a given distance from the first connector base, and a vertical locking portion extending downwardly from said horizontal portion through said second aperture and the aligned indexing opening, said locking portion including first detent means formed thereon to snap-engage the other side of the support member and second detent means which snap-engages the respective support member engaging tab, the snap-engagement of said first and second detent means occuring when said horizontal portion rests on said first connector base, whereby said second connector is positioned with respect to said support member and first connector.

2. The assembly of claim 1 wherein said pins are uninsulated and the spacer portion of said polarizing means cooperates with the first connector to space the second connector a sufficient distance from the first connector base to expose at least a portion of one of said pins.

3. The assembly of claim 2 including at least one conductive element electrically connected between said exposed pin and another part of the circuit.

4. The assembly of claim 3 wherein said conductive element is a wire wrap element.

5. The assembly of claim 3 wherein said conductive element is a buss bar.

6. The assembly of claim 1 wherein said pins extend from the other side of the support member, said assembly including a third electrical connector having a housing with recesses to receive said pins, each recess having a terminal mounted therein to electrically contact each pin.

7. The assembly of claim 1 wherein each second connector terminal is preloaded and biased against the interior of each recess.

8. The assembly of claim 7 wherein each second connector terminal has a loop-shaped portion adapted to engage its respective pin.

9. The assembly of claim 1 wherein said second connector includes mounting means formed thereon and said connector engaging portion of said polarizing pin engages said mounting means to removably attach said polarizing pin to said second connector.

* * * * *